US006748607B1

(12) United States Patent
Hong

(10) Patent No.: US 6,748,607 B1
(45) Date of Patent: Jun. 15, 2004

(54) BREATH GUARD ASSEMBLY FOR HELMET

(75) Inventor: Seong-Kug Hong, Yongin-si (KR)

(73) Assignee: HJC Co. Ltd., Kyunggi-do (KR)

( * ) Notice: Subject to any disclaimer, the term of this patent is extended or adjusted under 35 U.S.C. 154(b) by 0 days.

(21) Appl. No.: 10/452,844

(22) Filed: Jun. 2, 2003

(30) Foreign Application Priority Data

Apr. 28, 2003 (KR) ..... 2003-0026697

(51) Int. Cl.[7] ..... A42B 1/24
(52) U.S. Cl. ..... 2/422; 2/424; 2/435
(58) Field of Search ..... 2/422, 424, 435, 2/436, 437, 425, 171.3

(56) References Cited

U.S. PATENT DOCUMENTS

| | | | | | |
|---|---|---|---|---|---|
| 4,556,994 | A | * | 12/1985 | Kawasaki et al. | 2/424 |
| 4,667,348 | A | * | 5/1987 | Sundahl | 2/424 |
| 4,729,132 | A | * | 3/1988 | Fierro | 2/425 |
| 5,136,657 | A | * | 8/1992 | Hattori | 2/421 |
| 5,161,261 | A | * | 11/1992 | Kamata | 2/424 |
| 6,289,521 | B1 | * | 9/2001 | Ikeda | 2/421 |
| 6,417,491 | B1 | * | 7/2002 | Taniuchi | 2/424 |

FOREIGN PATENT DOCUMENTS

| | | | | | |
|---|---|---|---|---|---|
| EP | 97285 | A2 | * | 1/1984 | A42B/3/00 |
| GB | 1576647 | A | * | 10/1980 | A42B/3/00 |
| GB | 2186194 | A | * | 8/1987 | A62B/15/00 |
| JP | 02221403 | A | * | 9/1990 | A42B/03/24 |
| JP | 10110321 | A | * | 4/1998 | A42B/3/24 |

* cited by examiner

*Primary Examiner*—Rodney M. Lindsey
(74) *Attorney, Agent, or Firm*—R. Neil Sudol; Henry D. Coleman; William J. Sapone

(57) ABSTRACT

The present invention relates to a breath guard assembly for a helmet which is capable of effectively preventing a formation steam in a helmet shield, removing any inconvenience when wearing a helmet and capable of implementing an easier attaching and detaching operation of a breath guard from a helmet body. The breath guard assembly for a helmet comprises a breath guard which includes a guard body having a protrusion portion covering a nose portion of a helmet user, a cushion attached to a back portion of the guard body contacting with the nose portion of the helmet user, and more than one engaging terminals formed in a lower end portion of the guard body, for thereby minimizing a spreading of a user's breath of a helmet in an interior of a helmet and having a certain size for sufficiently covering a nose portion of a helmet user, and a guide which includes a guide body which is vertically inserted into a jaw portion of a front surface of the helmet, an air guide formed in an upper portion of the guide body in a flange shape in such a manner that an air from a front portion of the helmet is moved up along a portion between a shield of the helmet and an outer lateral surface of the breath guard, and an engaging protrusion formed on the air guide and engaged with the engaging terminal of the breath guard.

3 Claims, 8 Drawing Sheets

【Fig.1】 Prior Art
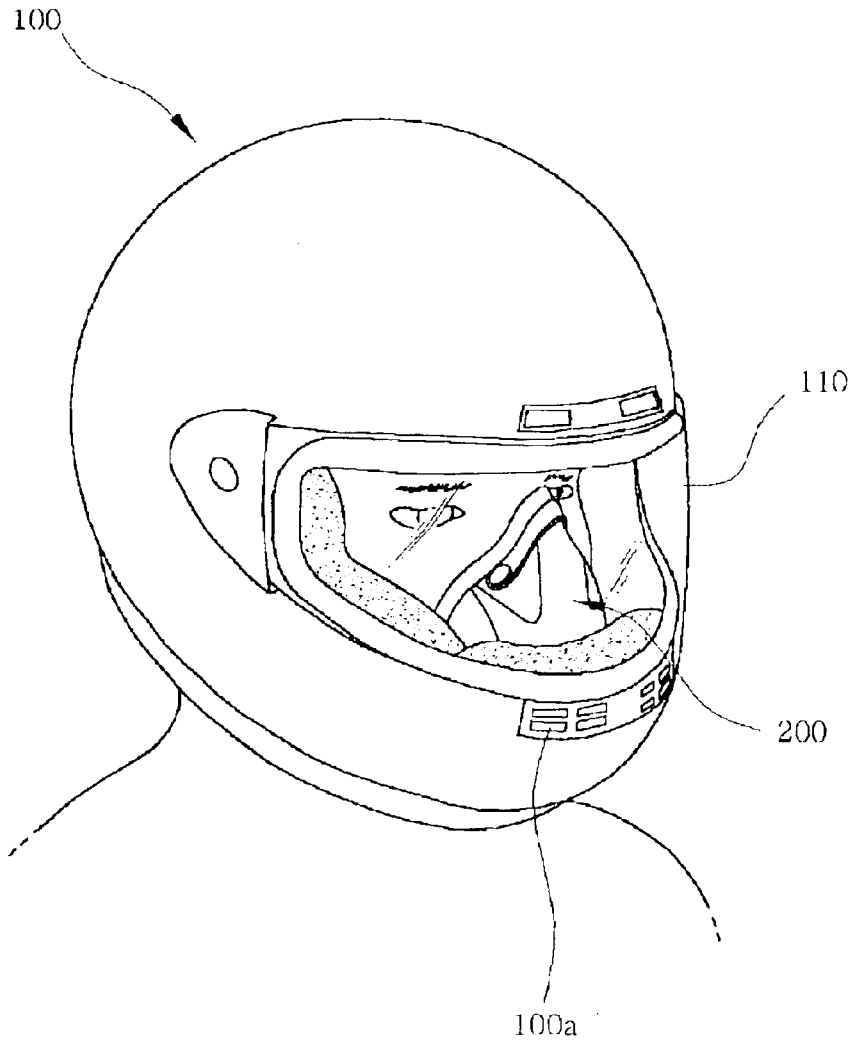

【Fig.2a】 Prior Art
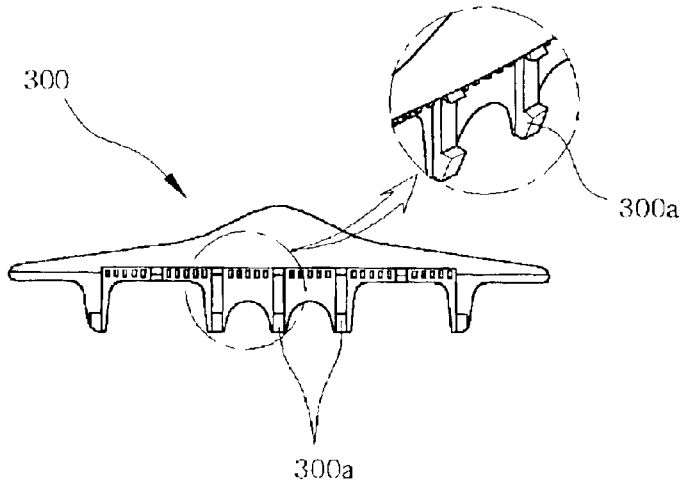
【Fig.2b】 Prior Art
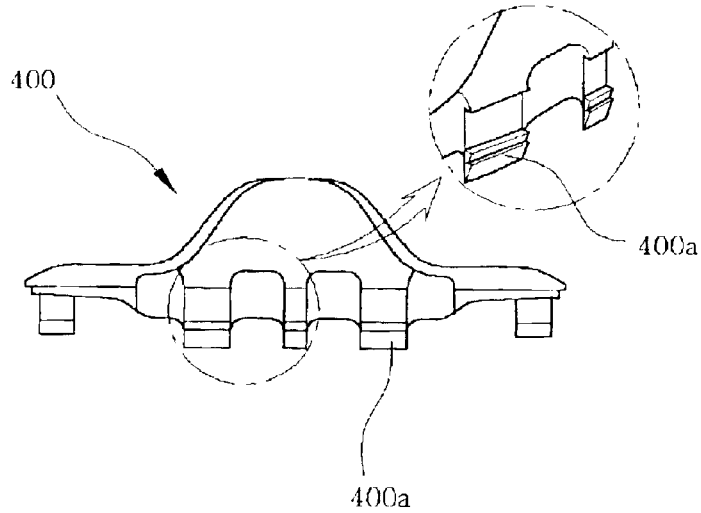

【Fig.3】
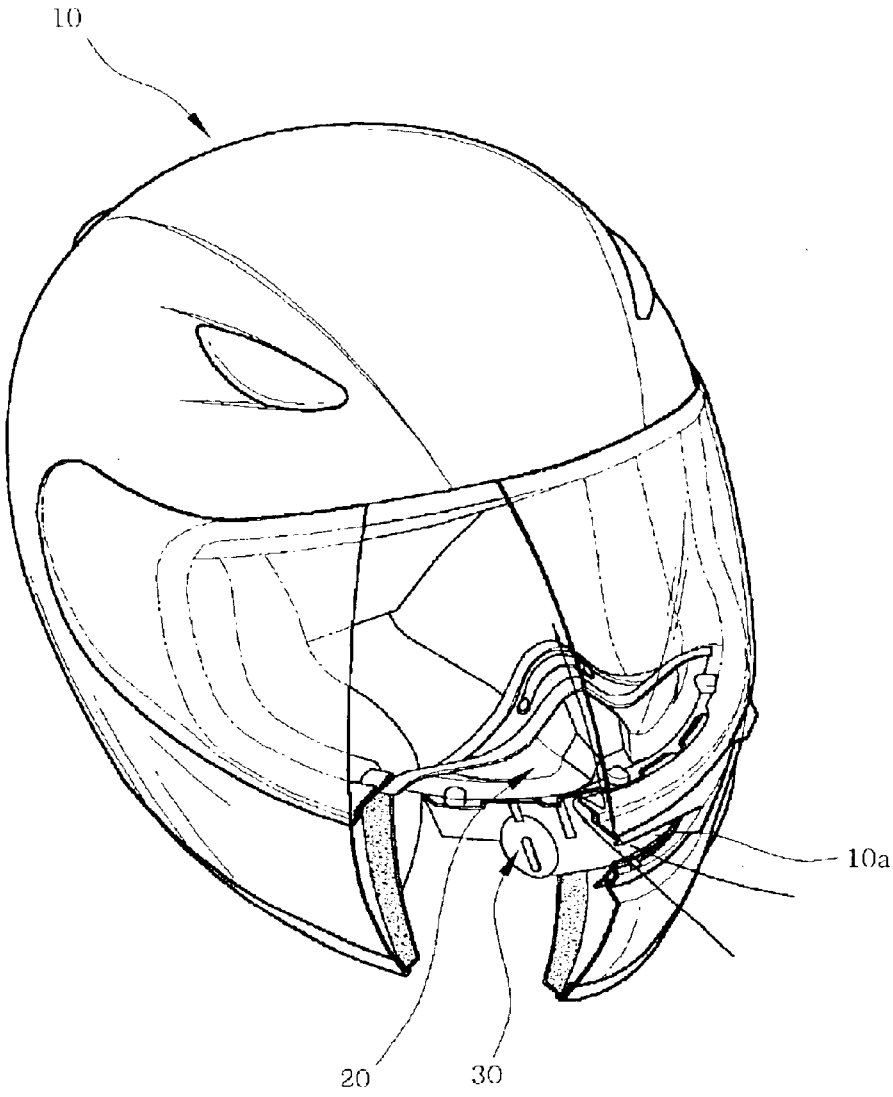

【Fig.4a】
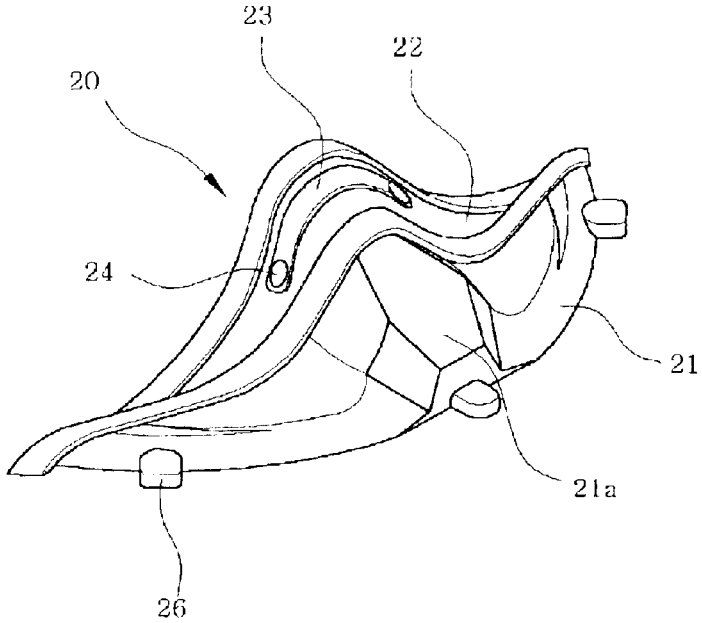
【Fig.4b】
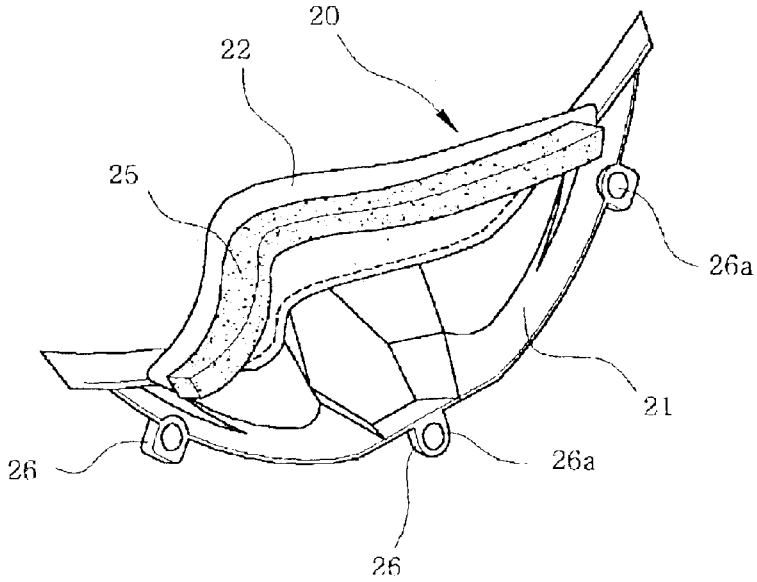

【Fig.5】
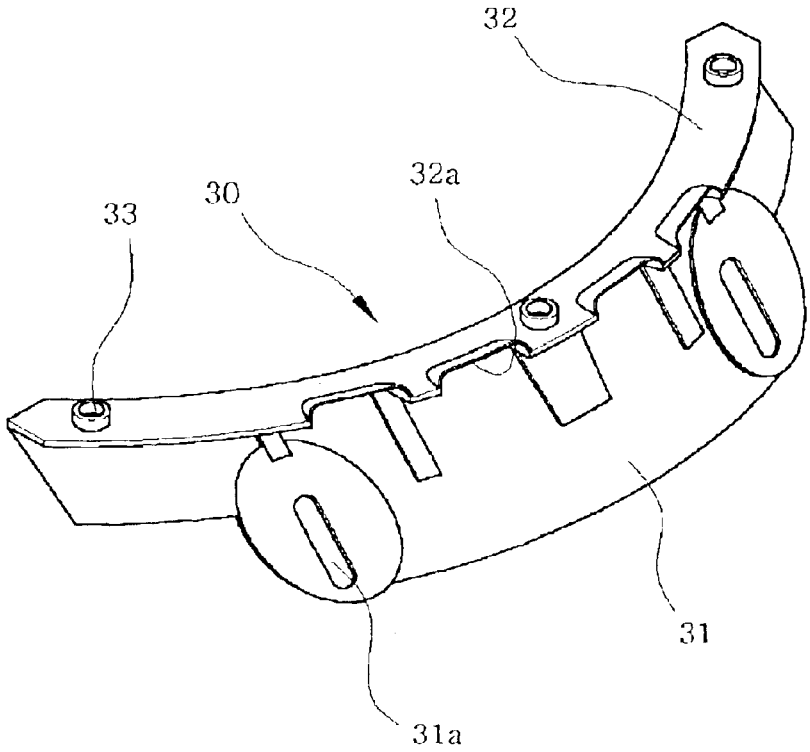

【Fig.6】
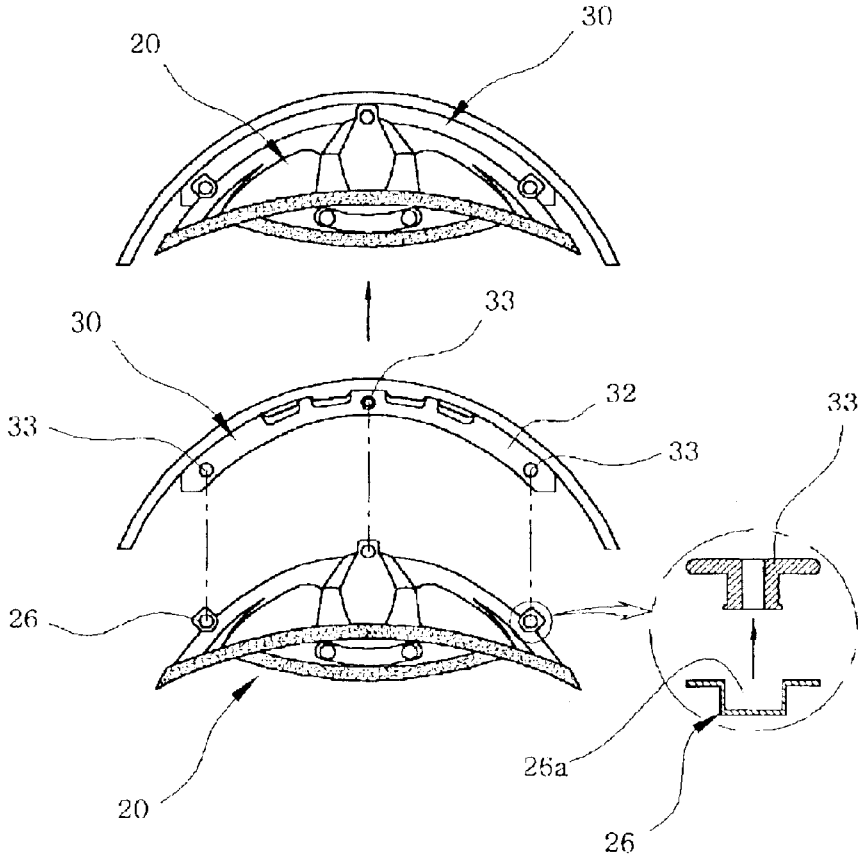

【Fig.7a】
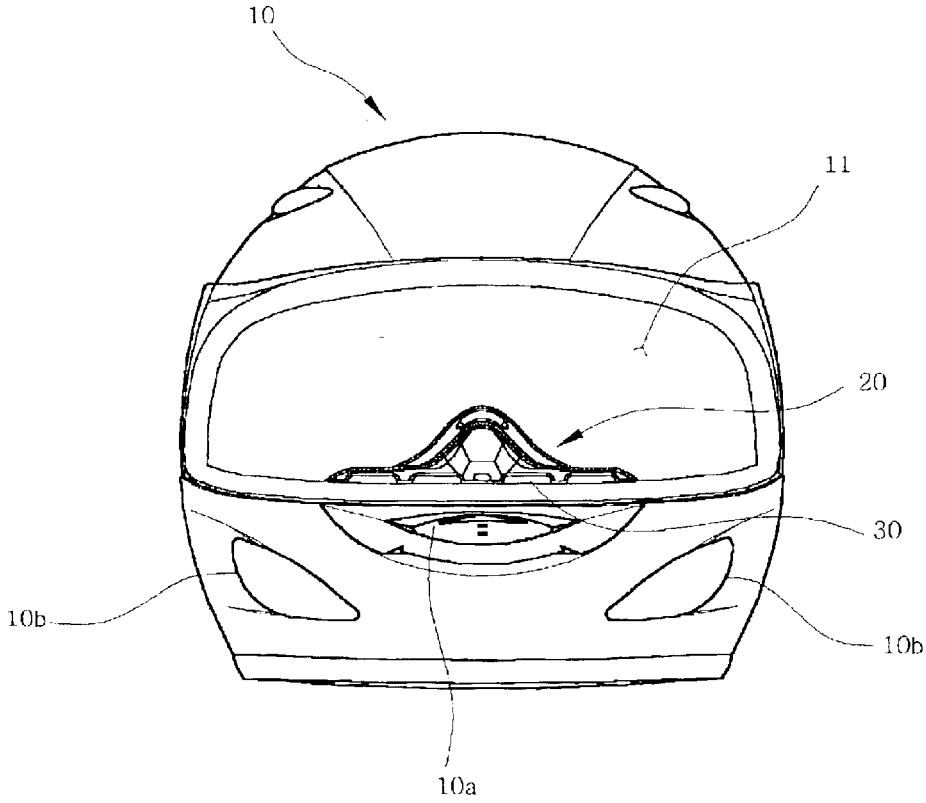

【Fig.7b】
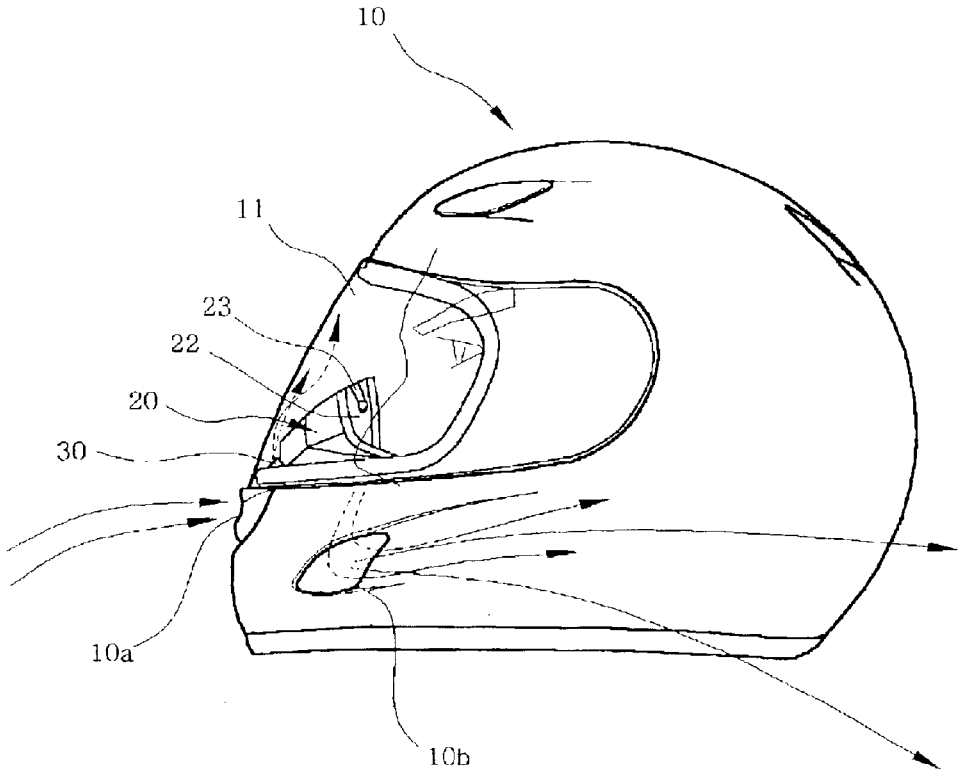

BREATH GUARD ASSEMBLY FOR HELMET

BACKGROUND OF THE INVENTION

1. Field of the Invention

The present invention relates to a breath guard assembly for a helmet, and in particular to a breath guard assembly for a helmet which is capable of preventing a formation of steam in a shield of a helmet due to a user's breath of helmet which is worn when driving a motorcycle.

2. Description of the Background Art

A helmet is generally used for protecting a user's head and obtaining a certain field of vision with respect to an accident which may occur when driving a motorcycle.

In particular, a transparent shield is engaged to a front side of the helmet for preventing a wind when a motorcycle runs at a high speed and a foreign substance from being inserted thereinto.

When a user breaths in a state that a user wears a shield, a steam may be formed in a shield due to a users breathing operation, so that it is impossible to obtain a field of vision. Furthermore, in the case that an outdoor temperature is low in the winter season, the above phenomenon increasingly occurs due to a high difference of temperature for thereby increasing a probability of accident.

As shown in FIG. 1, a breath box 200 is provided for preventing a breath of a helmet user from being directly contacted with a shield 110 of the helmet 100 and guiding the steam to the outside. The above breath box 200 has a certain size for fully covering a nose portion of a helmet user and covering a certain part of a face. An inner portion of the breath box 200 communicates with an air path 100*a* so that a breath of the helmet user is discharged to the outside through an air path 100*a* of a front portion of the helmet 100.

However, since the conventional breath box 200 has a certain size for too much covering a front side of the user's face, the user feels much inconvenience. In particular, the above inconvenience may be increased in the summer season due to an increased temperature and moisture in the interior of the helmet.

As shown in FIGS. 2*a* and 2B; the breath guards 300, 400 are provided. The above breath guards 300, 400 have a size for covering a nose portion of a helmet user in minimum, so that the inconvenience is slightly increased. However, the breath guards 300, 400 are not capable of fully covering the user's breath, so that a steam formation prevention effect of a shield is decreased. For example, in a state that the helmet is worn, when the motorcycle stops for about 5 seconds while it runs, a steam is formed in the shield of the helmet. When the motorcycle runs, it is possible to prevent a formation of steam by a wind which is flown into the interior of the helmet through a portion below a user's jaw. However, when the motorcycle is stopped, since there is not a forwarding blowing wind, the user's breath may spread in the interior of the helmet and may cause a formation of steam in the shield. The breath guards 300, 400 are engaged to the helmet by protrusions 300*a*, 400*a* which are formed in the lower portion. Since the protrusions 300*a*, 400*a* are formed in a shape of arrow tip, an engaging operation with respect to the helmet is easier, but it is impossible to detach the same. In addition, it is impossible to separate the same from the helmet for a washing or maintenance.

SUMMARY OF THE INVENTION

Accordingly, it is an object of the present invention to provide a breath guard assembly for a helmet which overcomes the problems encountered in the conventional art.

It is another object of the present invention to provide a breath guard assembly for a helmet which is capable of effectively preventing a formation steam in a helmet shield, removing any inconvenience when wearing a helmet.

It is further another object of the present invention to provide a breath guard assembly for a helmet which is capable of implementing an easier attaching and detaching operation of a breath guard from a helmet body.

To achieve the above objects, there is provided a breath guard assembly for a helmet which comprises a breath guard which includes a guard body having a protrusion portion covering a nose portion of a helmet user, a cushion attached to a back portion of the guard body contacting with the nose portion of the helmet user, and more than one engaging terminals formed in a lower end portion of the guard body, for thereby minimizing a spreading of a user's breath of a helmet in an interior of a helmet and having a certain size for sufficiently covering a nose portion of a helmet user, and a guide which includes a guide body which is vertically inserted into a jaw portion of a front surface of the helmet, an air guide formed in an upper portion of the guide body in a flange shape in such a manner that an air from a front portion of the helmet is moved up along a portion between a shield of the helmet and an outer lateral surface of the breath guard, and an engaging protrusion formed on the air guide and engaged with the engaging terminal of the breath guard.

BRIEF DESCRIPTION OF THE DRAWINGS

The present invention will become better understood with reference to the accompanying drawings which are given only by way of illustration and thus are not limitative of the present invention, wherein;

FIG. 1 is a perspective view illustrating a using state of a conventional breath box engaged to a helmet;

FIGS. 2A and 2B are a front view illustrating examples of various conventional breath guards;

FIG. 3 is a partial cross sectional perspective view illustrating an example of a helmet to which a breath guard assembly according to the present invention is engaged;

FIG. 4A is a front side perspective view illustrating a breath guard according to the present invention;

FIG. 4B is a back side perspective view illustrating a breath guard according to the present invention;

FIG. 5 is a perspective view illustrating a breath guard engaging guide according to the present invention;

FIG. 6 is a view illustrating an engaging step of a breath guard and a guide according to the present invention;

FIG. 7A is a front view illustrating another example of a breath guard engaged helmet according to the present invention; and FIGS. 7B is a side view illustrating a using state of a breath guard assembly in a helmet of FIG. 7A according to the present invention.

DETAILED DESCRIPTION OF THE PREFERRED EMBODIMENTS

The preferred embodiments of the present invention will be described with reference to the accompanying drawings.

As shown in FIG. 3, the breath guard assembly according to the present invention includes a breath guard 20 which covers a helmet user's nose, and a guide 30 for fixing the breath guard 20 to a front portion of the helmet 10.

As shown in FIGS. 4*a* and 4*b*, the breath guard 20 includes a guard body 21 in which a protrusion portion 21*a* protruded in a human nose shape is formed in the center portion, and a cover 22 which is formed of a flexible material such as a woven fabric or leather for thereby covering a nose portion of a helmet user. In particular, the guard body 21 and the cover 22 are capable of minimizing a spreading a breath in the interior of the helmet and have a minimum size for covering only a rim of a helmet user's nose. When comparing with the conventional breath box, an occupying area with respect to the face portion of the user is very small. In addition, an adjusting piece 23 fixed by such as a fastener is installed in the upper surface of the cover 22 for maintaining a transformed shape of the cover 22 when the cover is bent inwardly or outwardly. Therefore, the cover 22 is able to be flexibly transformed to be fit to the size and shape of the helmet user's nose and maintain the transformed shape by dint of the adjusting piece 23. The adjusting piece 23 is made of a plastic material such as an aluminum which is easily flexed by a small force of the user, and the surface of the same is coated with a vinyl. In addition, the guard body 21 is generally made of a smooth plastic which is easily transformed together with the cover 22 for thereby implementing an easy transformation of the cover 22 when flexibly transforming the cover 22 by using the adjusting piece 23. A cushion 25 like a sponge is attached to a back portion of the cover, namely, a portion which directly contacts with the nose of the helmet user for thereby decreasing any bad feeling when contacting with the surface of the guard body 21 of the cover 22. The breath guard 20 is fixed to the helmet by the guide 30 and includes more than one engaging portion 26 in the lower end portion of the guard body 21. In particular, the engaging portion 26 has a concave groove 26*a* in the lower side of the same, and three engaging portions 26 are preferably provided at both ends of the guard body 21 and the center portion of the same at a regular interval therebetween for thereby implementing a stable engagement with the guide 30.

Next, as shown in FIG. 5, the guide 30 is formed in an arc of a circle along the shape of the front portion of the helmet formed in a curved shape. In particular, the body 31 is formed of a thin plate which can be vertically inserted into the jaw portion of the helmet. In addition, a hole through which a fixing member such as a screw or a bolt passes is formed in a lower portion of the guide body 31 for thereby implementing a stable fixed state in a state that the guide body 31 is inserted in the jaw portion of the helmet. An air guide 32 is formed in the upper portion of the guide body 31 in a flange shape which is protruded in the forward direction of the helmet from the vertical surface of the guide body 31. In particular, a through hole 32*a* which is upwardly slanted is formed in the front portion of the air guide 32 in such a manner that the air flown in from the front side of the helmet is moved up along a portion between the shield 11 of the helmet and an outer surface of the breath guard 20. In addition, the protrusions 33 fixedly inserted into the grooves 26*a* formed in the engaging terminal 26 of the breath guard 20 are formed in the air guide 32 in the same number as the number of the engaging terminals 26 and at the regular interval.

The operation of the breath guard assembly according to the present invention will be described with reference to the accompanying drawings.

First, as shown in FIG. 6, the breath guard 20 is placed on the guide 30, and the engaging protrusions 33 formed in the upper surface of the air guide 32 of the guide 30 and the engaging terminals 26 of the breath guard 20 are arranged each other, and the engaging protrusions 33 are inserted into the grooves 26*a* of the engaging terminals 26 in a snap method. The breath guard 20 and the guide 30 are engaged in a state that the guide is fixedly inserted into the jaw portion of the front side of the helmet.

FIGS. 3 and 7*a* are views illustrating the examples of the helmet in which the breath guard assembly is installed according to the present invention. The air inlet portion 10*a* is formed in a front side of each helmet 10. For example, in a state that the motorcycle user, the user runs in the forward direction, the air is flown into the interior of the helmet 10 through the air inlet portion 10*a*. At this time, the flown-in air is upwardly moved through a portion between the shield 11 of the helmet 10 and the outer surface of the breath guard 20 by the through hole 32*a* of the guide 32 provided in the guide 30 according to the present invention and is uniformly contacted with the inner surfaces of the shield 11, so that it is possible to decrease a temperature difference between the inside and outside of the shield 11. The above operation will be well understood based on FIG. 7B. As shown therein, the air outlet port 10*b* is formed in the lateral surface of the helmet 10. Therefore, the user's breath is discharged to the outside through the air outlet port 10*b*. In particular, since the breath guide 20 of the present invention has a minimum size for covering a rim of the helmet user's nose, the user's breath of the helmet does not contact with the surface of the shield 11, and it is possible to minimize the spreading of the air into the helmet 10. Therefore, it is possible to prevent a formation of the steam on the shield 11 even when the motorcycle stops for a long time(about 30 seconds) while it runs.

In addition, when using the breath guard 20, since the size and shape of the nose of the user are different, the cover 22 of the breath guard may be contracted or changed in a certain shape using the adjusting piece 23 provided in the cover 22, so that it is possible to more effectively prevent a formation of steam in the shield 11.

As described above, the breath guard assembly for a helmet according to the present invention has the following effects.

First, the breath guard assembly has a proper size to cover a rim of the helmet user's nose, so it is possible to use the helmet in all seasons.

Second, it is possible to effectively prevent a formation of steam on a shield of a helmet by preventing a user's breath of the helmet from being directly affected to the helmet shield.

Third, it is possible to implement an easier washing or maintenance by easily attaching or detaching a breath guard from the helmet body.

As the present invention may be embodied in several forms without departing from the spirit or essential characteristics thereof, it should also be understood that the above-described examples are not limited by any of the details of the foregoing description, unless otherwise specified, but rather should be construed broadly within its spirit and scope as defined in the appended claims, and therefore all changes and modifications that fall within the meets and bounds of the claims, or equivalences of such meets and bounds are therefore intended to be embraced by the appended claims.

What is claimed is:

1. A breath guard assembly for a helmet, comprising:

breath guard which includes:

a guard body having a protrusion portion covering a nose portion of a helmet user;

a cushion attached to a back portion of the guard body contacting with the nose portion of the helmet user, and more than one engaging terminals formed in a lower end portion of the guard body, for thereby minimizing a spreading of a user's breath in an interior of a helmet and having a certain size for covering just a rim of a helmet user's nose; and a guide which includes:

a guide body which is roughly vertically inserted into a jaw portion of a front surface of the helmet;

an air guide formed in an upper portion of the guide body in a flange shape in such a manner that an air from a front portion of the helmet is moved up along a portion between a shield of the helmet and an outer surface of the breath guard; and an engaging protrusion formed on the air guide and engaged with the engaging terminal of the breath guard.

2. The assembly of claim 1, wherein a flexible cover is attached to an upper portion of the guard body contacting with a nose portion of a helmet user, and the cover has an adjusting piece made of a plastic material for maintaining a transformed shape fitted for a shape and size of the nose of the helmet user.

3. The assembly of claim 1, wherein an upwardly slanted through hole is formed in a front portion of the air guide in such a manner that an air from the front side of the helmet is moved up between the shield of the helmet and an outer surface of the breath guard.

* * * * *